US009730504B2

(12) United States Patent
Thierer

(10) Patent No.: US 9,730,504 B2
(45) Date of Patent: Aug. 15, 2017

(54) APPLICATOR WITH A NON-ROUND CORE AND A STAR-SHAPED BRISTLE SET

(71) Applicant: GEKA GmbH, Bechhofen (DE)

(72) Inventor: Gudrun Thierer, Feuchtwangen (DE)

(73) Assignee: GEKA GmbH, Bechhofen (DE)

( * ) Notice: Subject to any disclaimer, the term of this patent is extended or adjusted under 35 U.S.C. 154(b) by 105 days.

(21) Appl. No.: 14/639,021

(22) Filed: Mar. 4, 2015

(65) Prior Publication Data

US 2015/0257514 A1 Sep. 17, 2015

(30) Foreign Application Priority Data

Mar. 15, 2014 (DE) ..... 20 2014 100 982 U
Jul. 18, 2014 (DE) ..... 20 2014 103 325 U

(51) Int. Cl.

| | |
|---|---|
| ***A45D 40/26*** | (2006.01) |
| ***A46B 3/00*** | (2006.01) |
| ***A46B 3/04*** | (2006.01) |
| ***A46B 9/02*** | (2006.01) |

(52) U.S. Cl.

CPC ..... *A45D 40/267* (2013.01); *A46B 3/005* (2013.01); *A46B 3/04* (2013.01); *A46B 9/021* (2013.01); *A46B 2200/1053* (2013.01)

(58) Field of Classification Search

CPC .. A45D 40/262; A45D 40/264; A45D 40/265; A45D 40/267; A46B 3/005; A46B 3/04; A46B 9/021; A46B 2200/1053

See application file for complete search history.

(56) References Cited

U.S. PATENT DOCUMENTS

| | | | | |
|---|---|---|---|---|
| D642,805 | S * | 8/2011 | Burgess | D4/128 |
| 2009/0193602 | A1* | 8/2009 | Dumler | A46B 3/005 15/160 |
| 2012/0294664 | A1 | 11/2012 | Gueret | |
| 2013/0315647 | A1* | 11/2013 | Gueret | A45D 40/265 401/122 |
| 2014/0003857 | A1* | 1/2014 | Gueret | A45D 40/262 401/129 |

FOREIGN PATENT DOCUMENTS

| | | | |
|---|---|---|---|
| DE | 102004027098 | B4 | 10/2013 |
| DE | 202013105086 | U1 | 1/2014 |
| EP | 2084987 | A1 | 8/2009 |
| WO | 2011045770 | A1 | 4/2011 |
| WO | 2012140572 | A1 | 10/2012 |

OTHER PUBLICATIONS

Search Report from the German Patent & Trademark Office for DE 20 2014 100 982.5 dated Nov. 6, 2014.

* cited by examiner

*Primary Examiner* — Rachel Steitz

(57) ABSTRACT

A cosmetic applicator with a rod-shaped core and injection-molded fingers, wherein the core has a circumference surface and a non-round cross-section; the circumference surface is composed of large and small side surfaces arranged in alternating fashion; and preferably, all of the large side surfaces are the same size as one another and all of the small side surfaces are the same size as one another.

22 Claims, 4 Drawing Sheets

APPLICATOR WITH A NON-ROUND CORE AND A STAR-SHAPED BRISTLE SET

FIELD OF THE INVENTION

The invention relates to a cosmetic applicator and in particular, a mascara applicator with a rod-shaped core and injection molded fingers.

BACKGROUND OF THE INVENTION

For a long time, cosmetics and mascara were applied essentially exclusively using so-called wire core brushes. In such brushes, a number of filaments are placed between two legs of a U-shaped wire, which is then twisted. During the twisting action, the filaments are distributed between the two wire legs and form an applicator with outward protruding bristles all around, usually in a helical form.

In order to be able to change the application properties of such applicators, there are only a few parameters available, namely the number and type of filaments used. If use of these alone is insufficient, then the only remaining option is to perform finishing work on the completed brushes, i.e. to trim them, for example, in order to thus give them particular properties.

Recent times have seen increased use of cosmetic applicators with injection-molded bristles. Applicators of this kind offer significantly more variation options.

The patent DE102004027098 B4, for example, has disclosed an applicator of this kind. This applicator is equipped with a number of bristles distributed in essentially uniform fashion all the way around, between which are situated comb tines along a longitudinal side, but it is hardly possible to use these tines without simultaneously also bringing the lashes into contact with the bristles that are ready to apply the cosmetic.

Specifically in the application of mascara compound, different requirements must be met as well as possible. On the one hand, the applicator has to have the best possible compound-storing properties so that if possible, it needs to be dipped into the mascara compound only once and can then provide all of the lashes with the desired coating thickness. In addition, however, the applicator must also have so-called combing properties and separating properties because even thickly coated lashes must not adhere to one another, but must instead be separated from one another through deft use of the applicator.

The object of the invention, therefore, is to create an applicator with optimized application and separation properties.

SUMMARY OF THE INVENTION

Consequently, a cosmetic applicator with a rod-shaped core is provided, from which injection-molded fingers protrude. In this context, a rod-shaped core is understood to be a core that extends along the longitudinal axis L of the applicator and whose length in this direction is at least 5 times—better still 10 times—greater than the maximum core diameter.

As a rule, the rod-shaped core is solid. It is also possible, however, for it to be embodied as hollow or tubular.

In the present context, fingers are understood to be application elements that can either be flexible in essentially all directions and are then referred to as bristles or can have the property of comb tines.

According to the invention, the rod has a non-round cross-section so that its casing is composed of a plurality of circumference surfaces that can be differentiated from one another. These circumference surfaces are made up of alternating large and small side surfaces. A large side surface is characterized by the fact that its free surface is larger than that of a small side surface. Preferably, the free surface of a large side surface is larger than the surface of a small side surface by a factor of 2. Preferably, all of the large side surfaces are exactly—or at least essentially —the same size as one another and all of the small side surfaces are exactly—or at least essentially—the same size as one another.

According to the invention, the set of fingers is adapted to the respective side surfaces and the set of fingers on the small side surfaces includes plates, while the set of fingers on the large side surfaces is preferably composed exclusively of bristles.

This results in an applicator with novel application properties. The plates on the small side surfaces, which protrude farther as a rule, permit a precise, sensitive separation of the lashes. By contrast, the set of fingers on the large side surfaces, which is composed exclusively of bristles, permits a sustained application of mascara compound because this set of fingers has outstanding compound-storing properties.

It is advantageous for the invention if the large side surfaces are optionally embodied as curved concavely inward toward the central longitudinal axis of the applicator. The side surfaces then form a kind of trough or chute in the direction parallel to the longitudinal axis, which is not entirely emptied of the compound when the set of fingers passes through the wiper, which makes a significant contribution to the good compound-storing properties.

Likewise advantageous for the invention is the option of embodying the small side surfaces as curved convexly outward, once again in relation to the central longitudinal axis. With proper dimensioning, this allows the fingers that are composed of the plates to protrude outward a long way so that they can be used with no trouble for combing and separating, without simultaneously applying additional compound in the course of doing so.

In an embodiment that has turned out to be particularly preferable, the circumference surface of the core is composed of at least—and ideally only—three large and three small side surfaces, situated one after another in alternating fashion in the circumferential direction. This specific embodiment with only three small and three large side surfaces makes it possible to allow the plates, which are then preferably respectively situated in the vicinity of the tips of the triangle that this largely produces, to protrude outward by an extremely large distance.

It is particularly preferable to embody the respective plates so that they have two large main surfaces, two side surfaces, and one radially outer end surface. The two main surfaces extend completely or at least essentially perpendicular to the longitudinal axis of the applicator and the two side surfaces preferably diverge from each other in a V shape in the radial direction. Preferably the two main surfaces extend at least essentially perpendicular to the longitudinal axis of the applicator if the smaller angle that is included between each of the main surfaces and the longitudinal axis is not smaller than 87°. Preferably the main surfaces aim at each other (converge) in a radially outward direction.

Ideally, each of the two main surfaces of the relevant plate has a free surface that is at least 2.5 times as large as the free surface of one of its side surfaces.

Preferably, at least the overwhelming number of the plates (and preferably all of the plates) are embodied so that the radially outer end surface is oriented diagonally in such a way that each plate has one side surface that is longer in the radial direction and one that is shorter in the radial direction. In other words, the relevant plate is diagonally beveled in the region of its end surface. Consequently, the plate has an advancing direction with which it penetrates between individual lashes in the best way, depending on whether the applicator is rotated in one or the other direction during the application. This increases the flexibility in the use behavior; depending on how the applicator is moved, it is possible to achieve quite different application results.

It is also advantageous if the plates are embodied as needed so that they form a chisel edge in the region of their radially outer end surface. In this context, a chisel edge is understood to be a local, approximately roof-shaped tapering of the plate toward its radially outer end surface. Such a tapering is formed by virtue of the fact that the main surfaces of the plate widen out toward their outermost ends and specifically, are inclined toward each other in a roof-like fashion.

Alternatively, it is possible that the main surfaces of each plate are inclined to meet each other; i.e., aim at each other in a radially outward direction, so that the plate as a whole forms a blade. Additional chisel edges are not required.

Preferably, the cosmetic applicator according to the invention is embodied so that the set of fingers on the small side surfaces is composed of at least three—and preferably only three—rows of fingers situated one after another in a line extending in the direction of the longitudinal axis of the applicator. In this case, the middle row of these fingers is preferably composed exclusively of bristles, while the two rows on the sides are preferably rows in which bristles and plates alternate in the direction extending along the longitudinal axis of the applicator. Preferably, the alternation occurs in such a way that a bristle is always followed by a plate and vice versa so that they always come one after another in alternating fashion.

Such an embodiment results in exposed plates that can be used, as mentioned above, to produce good combing results. Preferably, as mentioned above, a plate is provided only every second time, with a respective bristle situated between two plates in the respective row. This prevents excessively narrow interstices between the plates, which would lead to excessive amounts of mascara compound remaining after the applicator is pulled out through the wiper.

Preferably, the embodiment is such that the middle row of fingers that make up the set of fingers on the small side surfaces has a smaller total number of fingers than the two side rows. Preferably, the smaller number of fingers is implemented in that only one finger belonging to the middle row is provided at a location even with that of every second finger of the two outer rows, counting in the direction of the longitudinal axis of the applicator. In this way, it is possible to provide a relatively large open space along a circumferential line between the plates because in this case, no bristle is positioned in the middle row. A bristle that protruded from the middle between two plates, viewed in the circumference direction, would have no function due to the dominance of the plates, and would instead be in the way. For this reason, it is omitted.

The three rows of fingers, which respectively represent the set of fingers belonging to one of the small end surfaces, thus advantageously successively form the following pattern in the direction of the longitudinal axis of the applicator: one bristle in each of the two outer rows of fingers is arranged in a line along a shared circumference line. Immediately next to this, viewed in the longitudinal direction of the applicator, a respective plate in each of the outer rows of bristles and a bristle in the middle row of bristles are arranged in a line along a shared circumference line. Then the pattern starts again from the beginning. Depending on the desired application result, this pattern starts either with two bristles in the two outer rows of bristles, each positioned in a row in the circumference direction and then continues as described above or this pattern begins at the free end surface with two plates in the two outer rows of fingers, each arranged in a line extending along a circumference line, and a bristle in the middle row of fingers, which is situated in the middle between them in the same line.

It is particularly advantageous if the fingers of the middle row are the fingers that respectively constitute the set of fingers of a small side surface and are longer—preferably at least one quarter longer—than the fingers of the respective laterally adjacent rows that belong to the set of fingers of the same small end surface of the cosmetic applicator. In this way, the fingers of the middle row of a small end surface are the ones that protrude the farthest. In other words, these fingers represent the most exposed elements, which can be used to begin a separation in a very sensitive fashion, which process is continued by the plates, which are also quite exposed and are the next element to push between the lashes.

In a preferred embodiment, the set of fingers of the large side surfaces is composed of only three rows of bristles respectively situated one behind another in a line extending in the direction of the longitudinal axis of the applicator. In other words, the large side surfaces are equipped exclusively with bristles. This means that the large side surfaces are the surfaces that are mainly used for applying the cosmetic or mascara compound.

In a preferred embodiment, the middle row of the fingers constituting the set of fingers of the large side surfaces has a smaller total number of fingers than the two side rows. Preferably, only one finger belonging to the middle row is provided at a location even with that of every second finger of the two outer rows, viewed in the direction of the longitudinal axis of the applicator. This can have a positive influence on the compound-storing properties.

It is particularly advantageous if the three rows of bristles, which respectively constitute the set of fingers of one of the large side surfaces, successively form the following pattern in the direction of the longitudinal axis of the applicator: one bristle in each of the two outer rows of fingers is arranged in a line along a shared circumference line. Continuing in the direction of the longitudinal axis of the applicator, this is then respectively followed by a single bristle of the middle row of bristles. In the next step in the direction of the longitudinal axis of the applicator, comes a bristle in each of the two outer rows of fingers, which bristles are arranged in a line extending along a shared circumference line. Continuing further in the direction of the longitudinal axis of the applicator, this is adjoined once again by a single bristle of the middle row of bristles. This pattern repeats continuously. Depending on where the focus of the application lies in the individual case, this pattern can either begin starting from the free end surface of the core with two bristles in the two outer rows of bristles, which are situated one after another along a line in the circumference direction, or with one bristle in the middle row.

It is particularly advantageous if the bristles that constitute the set of fingers of the large side surfaces are each at least one quarter shorter than the fingers or than most of the fingers or better still, than all of the fingers that respectively constitute the set of fingers of a small side surface.

It turns out to be particularly advantageous if the core of the applicator is curved in a sickle shape in one plane. The applicator core therefore assumes the form of a sickle when it is viewed in the relevant plane.

Ideally, a small side surface of the core constitutes the outside of the sickle, i.e. the convexly curved spine of the sickle. In this way, the fingers that constitute the set of fingers on the small side surface—and in particular the fingers embodied in the form of plates situated underneath—extend with the maximum degree of freedom so that when the applicator is held in a corresponding fashion, an optimum separating action can be achieved with the aid of the plate-shaped fingers because they extend so freely that there is practically no danger that during the separation, the lashes will undesirably come into contact with the set of fingers on the large side surface that stores most of the mascara compound.

In the same sense, it is ideal if a large side surface of the core constitutes the inside of the sickle, i.e. the concavely curved surface of the sickle.

Separate protection is claimed for a cosmetic applicator with a rod-shaped core and fingers that are integrally connected to the circumference surface of the core, which fingers are arranged in rows extending in a direction parallel to the longitudinal axis of the applicator; in the circumference direction, the following finger set pattern repeats several times, preferably three times, in succession:

A first row of fingers, which is composed of plates that have a maximum span ra1 in the radial direction, immediately adjacent to this, at least one second row of fingers, which is composed of bristles that have a maximum span ra2 in the radial direction, immediately adjacent to the one or more—preferably two—second rows, a third row of fingers, which is composed of plates that have a maximum span ra1 in the radial direction; immediately adjacent to this, a fourth row of fingers that have a maximum span ra3 in the radial direction; immediately adjacent to this, a fifth row of fingers is preferably provided that have a maximum span ra3* in the radial direction; and ideally, (optionally) immediately adjacent to this, a sixth row of fingers is provided that have a maximum span ra3 in the radial direction, where: ra2>ra1>ra3, and at the same time, ideally ra3>ra3*.

Separate protection is also claimed for a cosmetic applicator system having a cosmetic applicator of the above-described type and a wiper; the span of the fingers in the radial direction is matched to the wiper so that the wiper does not wipe—or essentially does not wipe—the first row and third row of fingers and the wiper wipes the one or more second rows in a region that corresponds to at least the radially outermost ⅕ of the finger and to at most the radially outermost ½ of the finger and the wiper does not wipe the fourth and optional fifth and optional sixth row of fingers.

In this case, it is particularly advantageous if the cosmetic applicator system also includes a wand and the diameter of the wand is greater than an imaginary circle drawn around the longitudinal axis of the applicator L, whose radius is determined by the maximum radial span ra3 of the fourth row of fingers or, if provided, by the maximum radial span of the fingers of the fourth or fifth or sixth row of fingers that protrude the farthest in the radial direction. Such an embodiment has the significant advantage that the wiper wipes the wand clean. But since the outer diameter of the wand at its surface is greater than the diameter predetermined by the bristles of the fourth or fifth or sixth row of fingers, this ensures that the wiper does not fold down the fingers of the fourth or fifth or sixth row, but instead, the fingers of these rows duck under the wiper, so to speak. In this way, in the region of the fingers and radially above the region of the fingers and mostly radially above the region of these fingers, a not insignificant store of mascara compound remains even after the applicator has passed all the way through the wiper, which considerably facilitates the effective application of mascara compound without having to dip the applicator into the mascara compound several times to reload it.

Other advantages, effects, and embodiment possibilities of the invention ensue from the following description of an exemplary embodiment, taken in conjunction with the figures.

DETAILED DESCRIPTION OF THE PREFERRED EMBODIMENTS

Figure 2:
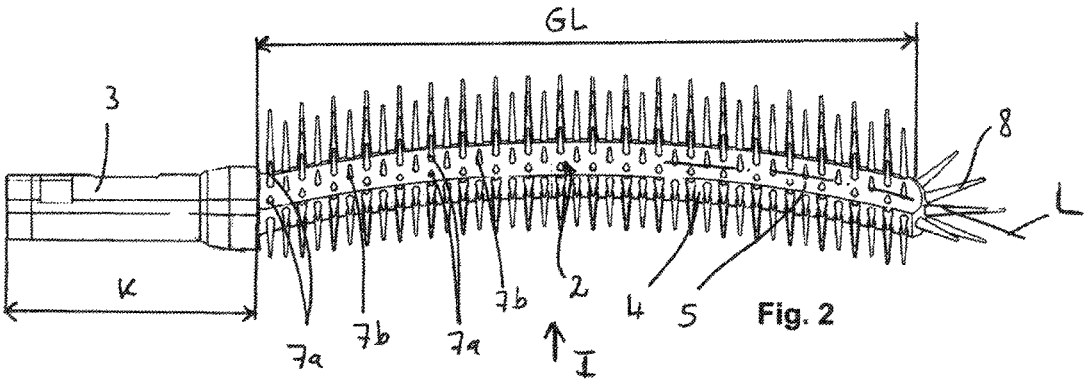
FIG. 2 shows the same exemplary embodiment, viewed from the side.

FIG. 2 gives the quickest overview of the exemplary embodiment of the applicator according to the invention 1 as described here.

The applicator 1 is composed of a core 2, which in this case is curved in the form of a sickle, but can also be straight if necessary, an embodiment that is not shown in the drawing here.

The core 2 could transition directly into a wand, which in turn is connected, for example, to a handle. For many application instances, however, it is advantageous if the core 2 is not integrally connected to a wand, but instead has a coupling section 3 by means of which it can be affixed to a corresponding wand, which is produced separately, possibly together with the handle.

The applicator according to the invention is in particular used as a mascara applicator, which is why it is of such delicate dimensions.

Unlike what is shown in the very enlarged depiction here, the total length GL of the section equipped with the bristles is usually less than 40 mm, but is most often even less than 30 mm.

Figure 4:
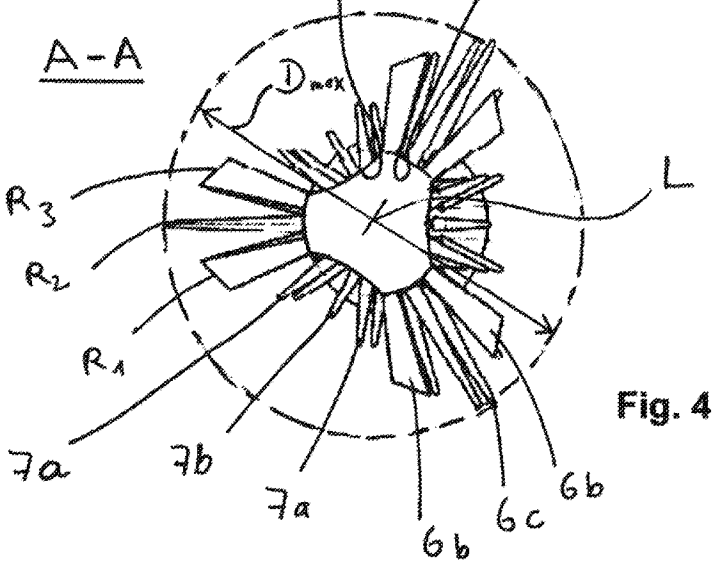
FIG. 4 shows a section along the line A-A, which is indicated in FIG. 3.

The maximum outer diameter Dmax of the applicator including its set of fingers is similar in size, see FIG. 4. This maximum outer diameter corresponds to the diameter of the smallest circle that can be placed around the applicator (see FIG. 4) and as a rule is ≤10 mm, typically even ≤8 mm.

The coupling section in turn typically has a length of ≤12.5 mm.

As is most clearly visible in FIG. 4, the core 2 does not have a circular cross-section. Instead, the core is profiled so that its circumference surface is made up of small side surfaces 4 and large side surfaces 5. As is clear from the drawing, the small side surfaces 4 are curved convexly outward relative to the center point of the core, whereas with the large side surfaces 5, preferably exactly the opposite is true: they are curved concavely inward, likewise relative to the center point of the core. The profiling of the core 2 in this case is preferably selected so that there are three small side surfaces 4 and three large side surfaces 5, which follow one after another in alternating fashion, viewed in the circumference direction.

One variant would be to provide not three small and three large side surfaces of the type mentioned above, but instead four of each kind of these side surfaces.

Before discussing the details, it should first be noted that the following is immediately clear from FIG. 4, which for the person skilled in the art, sets the applicator apart from the previously known applicators. The applicator has a respective row of fingers situated at the angle of 3×120° and preferably on each of its small side surfaces, which protrudes far beyond the surrounding rows of fingers, preferably by at least ¼ of its length. This gives the applicator a conspicuous, star-shaped appearance and gives the applicator a novel use behavior due to the powerful degree of exposure of this row of fingers.

This is optionally promoted by the fact that the above-mentioned rows of fingers are each framed on both sides by plate-shaped fingers that are inclined so that they point toward the fingers of the protruding row of fingers. The bolstering action of these plate-shaped fingers contributes to an even greater specificity of the novel use behavior.

Turning now to the details, the following must then be noted:

As is most clearly visible in FIG. 2, the set of fingers of each of the small side surfaces in this case is composed of three rows R1, R2, and R3 of fingers. It should be noted that a fourth row, for example in the form of a central double- or twin row, could optionally be added, but this has been excluded from the preferred exemplary embodiments and is not shown in the drawings here.

These three rows R1, R2, R3 are preferably arranged so that a middle row R2 extends parallel to the longitudinal axis of the core 2 along the middle of the small side surface 4. The two other rows of fingers R1, R3 that make up the set of fingers of the small side surfaces 4 are preferably positioned symmetrical to the middle row of fingers R1. Ideally, they are positioned such that the two side rows of fingers R1, R2 form a V-shaped arrangement relative to each other, viewed from the end, and the middle row of fingers R2 is positioned on the angle bisector between the two legs of the V.

Figure 3:
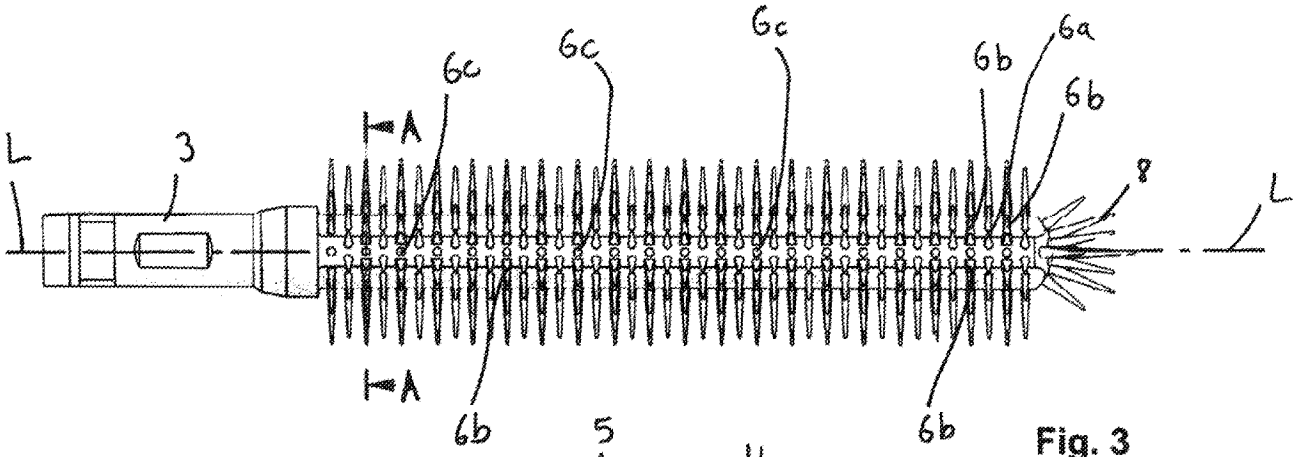
FIG. 3 shows the same exemplary embodiment, viewed from the side.

A precise comparison of FIGS. 3 and 4 shows that the two outer rows of fingers R1, R3 that constitute the set of fingers of the small side surface 4 are each composed of alternating bristles 6*a* and plates 6*b*. In other words, within a row, a bristle 6*a* is always followed by a plate 6*b* in a successively alternating fashion in the direction of the longitudinal axis.

This comparison also shows that the fingers of the middle row are exclusively composed of bristles 6*c*.

It is noteworthy that the bristle density of the middle row R2, which in this case forms part of the set of fingers of the small side surface 4, is only half as great as the finger density of the two other rows R1 and R3. Specifically, a bristle 6*a* is provided in the middle row R2 whenever on the right and left next to the bristle 6*a*, there are respective plates 6*b* of the two outer rows of fingers R1 and R3. Next comes one bristle 6*a* in each of the two outer rows of fingers R1 and R3; here, the middle row R2 has no bristle, but instead has an empty space.

Further inspection, especially of FIG. 4, reveals that the fingers of the middle row of fingers R2 that forms part of the set of fingers of the small side surface 4, are at least one quarter longer in the radial direction than the fingers of the two outer rows of fingers R1 and R3 that form part of the set of fingers of the small side surface 4.

In this way, the fingers 6*c* of the middle row of fingers R2, specifically because they are embodied in the form of long bristles, constitute a very sensitively controllable application element. They do not impair the combing function performed by the plates 6*b*, particularly because the middle bristles 6*c* are preferably provided with only a low density.

It is also worth noting in connection with FIG. 4 that the plates 6*b* belonging to the fingers of the two outer rows of fingers R1 and R3 that form part of the set of fingers of the small side surface 4, with their outer edge viewed in the circumference direction are tangential to or extend marginally across the jump discontinuity with which the one small side surface 4 transitions into a large side surface 5, in other words, the plates are standing "on edge."

To the extent that bristles form part of the set of fingers of the small side surface 4, the general statements made below with regard to bristles of this kind also apply to the bristles here.

For the plates 6*b* that form part of the set of fingers of the small side surface here, these plates 6*b* each have two main surfaces H on their front and back that are preferably oriented essentially orthogonal to the longitudinal axis of the applicator, two side surfaces S oriented in the circumference direction, and one radially outer end surface ST. The two side surfaces preferably extend away from each other in a V shape in the radial direction. The two main surfaces H are each larger in area than the two side surfaces S by a factor of at least 3 or better still, by a factor of 4. The plates 6*b* are nevertheless preferably embodied as quite narrow —most significantly, narrower than the plates that are usually used in cosmetic applicators. Consequently, each plate, at the height of its free end surface, relative to the central longitudinal axis, preferably occupies an arc angle AL of only ≤15°—better still of only ≤11°.

It should also be noted that the radially outer end surface ST preferably extends in an inclined fashion so that each plate 6*b* has one side surface S that is longer in the radial direction and one that is shorter in the radial direction. On the whole, the embodiment of the plates 6*b* that are preferred according to the invention can be described as "necktie-like, with an end that is cut off at an angle."

It is also noteworthy that FIG. 3 clearly shows that the two main surfaces H of each plate 6*b* are inclined toward each other so that the respective plate 6*b* narrows from its base to its radially outer end.

If need be, the plates 6*b* at their radially outer end surfaces form a chisel edge, i.e. forming a blade-like taper. This makes it easier to separate the lashes because it is possible to comb them apart from each other with the chisel edge, even if they are loaded with mascara compound.

Figure 1:
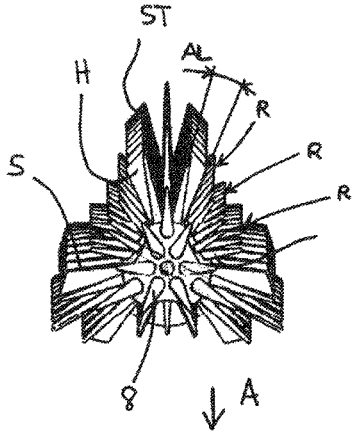
FIG. 1 shows an exemplary embodiment of an applicator according to the invention, viewed from the front.

Finally, FIGS. 1 and 4 also clearly show the appearance of the set of fingers on each large side surface 5.

In this case, the sets of fingers of the large side surfaces are each composed of only three rows RI, RII, and RIII, each of which is composed of fingers arranged one after another in a line extending in the direction of the longitudinal axis of the applicator, which fingers are preferably uniformly embodied in the form of bristles.

Last but not least, it should be noted that fourth rows RIV, for example in the form of a central double- or twin row, can be optionally added, but this has been excluded from the preferred exemplary embodiments and is not shown in the drawings here.

The placement of the rows of fingers RI through RIII relative to one another is similar to the placement of the rows of fingers R1 through R3—which form the set of fingers of the small side surfaces —relative to one another.

The pattern of the fingers 7*a* and 7*b* is noteworthy here. One finger 7*a* in each of the outer rows of fingers RI and RIII is arranged in a line along a shared circumference line. Continuing from there in the direction parallel to the longitudinal axis, these are followed by a single finger 7*b* in the middle row of fingers RII. Advancing further along the longitudinal axis of the applicator, this is then followed by one finger 7*a* in each of the two outer rows of fingers RI and RIII, which are arranged in a line along a shared circumference line. Next, continuing onward, comes a single finger 7*b* in the middle row of fingers.

In this case, at the free end surface of the core 2, the beginning can be composed of the fingers 7*a* in the two outer rows of fingers RI and RIII or can be composed of one finger 7*b* in the middle row of fingers RII.

The above-described pattern then continues in the direction of the longitudinal axis of the applicator L until the end of the bristle set is reached.

Also noteworthy is the preferred embodiment form in which the fingers of the middle row RII, with their outer, free ends, preferably terminate earlier in the radial direction (i.e. further inward in the radial direction) than the fingers of the two outer rows RI and RIII that encompass them and, together with them, form the bristle set of a large side surface.

As mentioned above, the core 2 of the applicator 1 is curved in a sickle shape in one plane, namely in the plane of the drawing that is shown in FIG. 3.

Ideally, a small end surface 4 constitutes the outside of the sickle, which is labeled with the arrow A in FIG. 3.

It is likewise advantageous if a large side surface of the core constitutes the inside of the sickle, which is labeled with the arrow I in FIG. 3.

Ideally, the core 2 and all of its fingers 6*a* through *c* and 7*a, b* are injection-molded in a single shot out of the same material.

Alternatively, however, it is also conceivable to use overmolding to mold a plurality of individual fingers or rows of fingers in order to produce them, for example, out of a different—or differently colored—material. It is also alternatively possible to produce a plurality of individual fingers or rows of fingers by injecting a second plastic compound from the inside along a cavity of the core 2 after the production of the core, which second plastic compound penetrates the core wall at certain locations due to its pressure and then shoots into a finger- or bristle cavity situated behind this wall. In this way, a tubular core is produced, from which part of the fingers and/or bristles protrude as an integral component thereof and from which another group of fingers and/or bristles protrude, which are integrally connected —through the openings in the core—to a second plastic that fills the interior of the core.

Finally, it should also be noted that the additional set of fingers, which is composed of a number of bristles 8—preferably at least 9 of them—that the applicator supports on the free end surface of its core 2, can form a very effective operative connection with the exposed bristles and the plates supporting them, which can distinguish the applicator according to the invention. These bristles preferably do not include an angle with the longitudinal axis that is bigger than 30°. The exposed bristles and plates permit a very efficient combing and separating along a greater length, whereas the bristles on the end surface make it possible to locally rework the combing and separating result, which is already good anyway.

Figure 5:
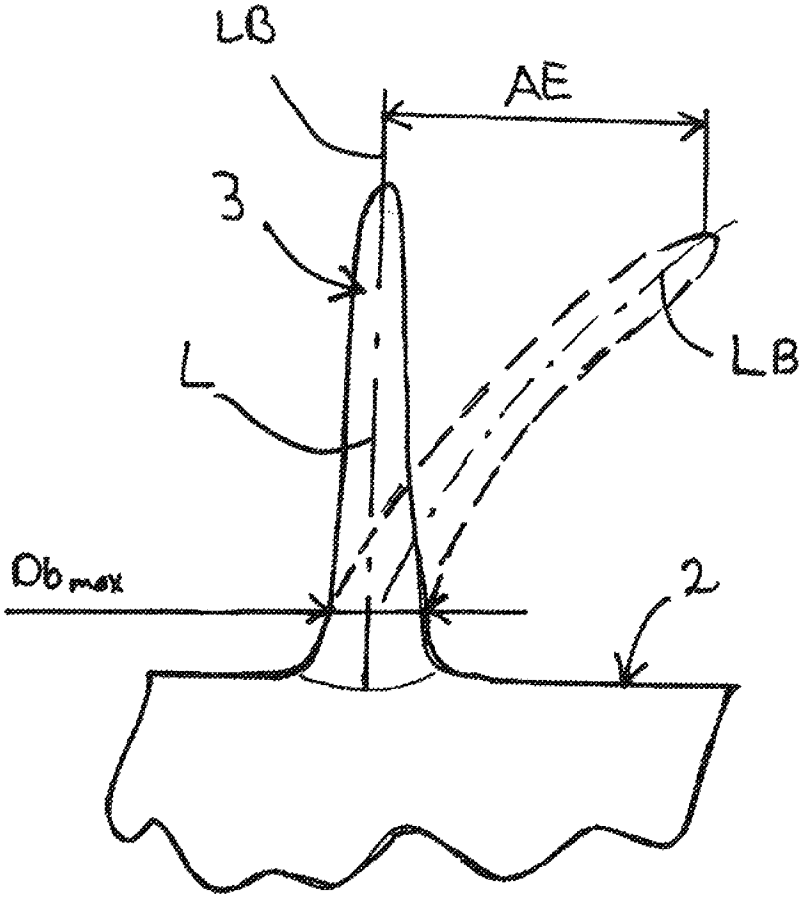
FIG. 5 is a very general illustration of what a finger in the form of a bristle is understood to mean in the context of the invention.

With regard to the definition of the term bristle, reference is hereby made to FIG. 5.

In this context, a bristle is understood to be a rod-shaped element, whose maximum diameter Dbmax in the region above the rounding/throat with which it transitions into the core 2, is smaller by a factor of 4—better still by a factor of at least 6—than the free length of the bristle with which the bristle protrudes from the applicator core.

As a result, a finger to be classified as a bristle is elastic enough that the amount AE by which the tip of the element referred to as the bristle can be elastically deflected to the side from its home position without damage to the bristle is greater than the above-defined maximum diameter Dbmax at least by a factor of 4, or better still by a factor of 5.

Unlike a plate, a bristle is typically an element that can be elastically deflected in all directions perpendicular to the direction of its longitudinal axis, whereas the plate has at least two opposing directions in which it exhibits a large amount of resistance to bending over.

In other words, in the broadest sense, a bristle is understood to be a flexible element.

A plate does not meet this definition; specifically, the plates described here are essentially rigid in the circumference direction, i.e. they do flex a little in the circumference direction, but cannot be arbitrarily deflected by a multiple of their maximum diameter.

Figure 7:
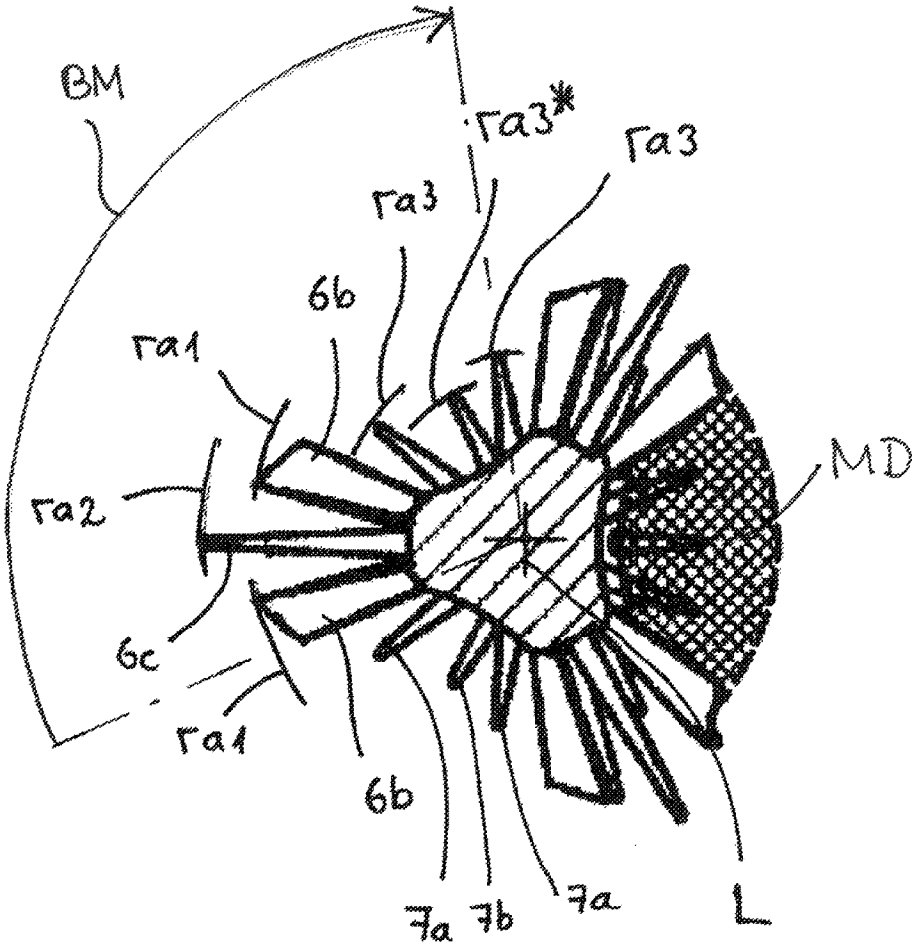
FIG. 7 is an enlarged depiction of the applicator shown in FIG. 6 in order to demonstrate how the pattern of different fingers repeats in the circumference direction.
Figure 6:
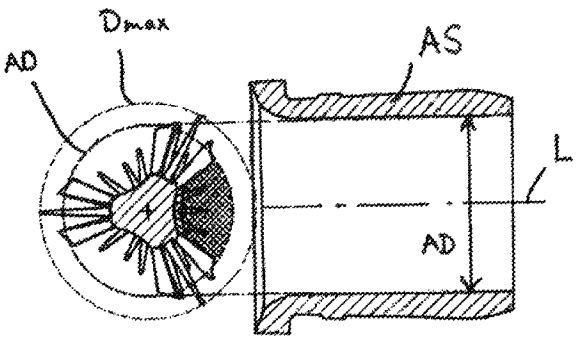
FIG. 6 shows the system composed of the applicator and wiper, which is another focus of the invention.

FIGS. 6 and 7 are provided to describe another aspect of the invention as follows:

The cosmetic applicator 1 has a rod-shaped core 2, which has fingers that are integrally joined to its circumference surface. The fingers are arranged in rows in a direction parallel to the longitudinal axis. With regard to the aspect that is relevant here, the applicator according to the invention is distinguished by the fact that in succession in the circumference direction, it has the following finger set pattern, which repeats several times, ideally 3 times:

In FIG. 7, the finger set pattern begins at the lower end of the arrow BM. The beginning is formed by a first row of fingers that are composed of plates 6*b*, which are positioned one after another along the core 2 in the direction parallel to the longitudinal axis L and which have a maximum span ra1 in the radial direction, as indicated by the corresponding segment of a circle depicted in FIG. 7. The term plate has already been defined above.

Continuing in the clockwise direction, immediately adjacent to this comes at least one second row of fingers, which is composed of bristles 6*c*. The bristles 6*c* are likewise positioned one after another along the core 2 in a direction parallel to the longitudinal axis. The bristles 6*c* have a maximum span ra2 in the radial direction, as is also indicated by a segment of a circle in FIG. 7.

In FIG. 7, only a single second row of fingers in the form of bristles 6*c* is provided, but if needed, this row can be doubled, i.e. there are then two rows of fingers that are composed of bristles 6*c*, but this is not shown in the drawing here.

Continuing on in the clockwise direction along the arrow BM, immediately adjacent to the second row, a third row of fingers is provided, which in turn is composed of plates 6*b*. The plates 6*b* are positioned one after another along a line in a direction parallel to the longitudinal axis L and preferably likewise have a maximum span ra1 in the radial direction.

Immediately adjacent to this, once again continuing in the clockwise direction along the arrow BM, a fourth row of fingers 7*a* is provided. These fingers are also positioned one after another along the core 2 in a direction parallel to the longitudinal axis L. These fingers of the fourth row have a maximum span ra3 in the radial direction. The fingers of the fourth row are embodied in the form of bristles 7*a*.

Preferably adjacent to this, once again continuing in the clockwise direction along the arrow BM, a fifth row of fingers is provided, which are composed of bristles 7*b*. These bristles are also positioned in a line parallel to the longitudinal axis L. These bristles 7*b* have a maximum span ra3* in the radial direction, as indicated by the corresponding segment of a circle shown in FIG. 7.

Optionally, another sixth row of fingers is provided, which is in turn composed of bristles 7*a*. This sixth row is situated immediately adjacent to the fifth row, viewed in the clockwise direction along the arrow BM. The sixth row is preferably the last row of fingers before the pattern described up to this point repeats in the circumference direction. The fingers of this sixth row have a maximum span ra3 in the radial direction; in other words preferably, the radial span of the fourth row and the sixth row, if present, are identical.

Ideally, and in most cases, in a row of fingers formed by a number of fingers all one behind the other in a longitudinal direction, all fingers are identical. For other cases, it is preferred if such a row of fingers consists of fingers alternatingly designed as plates and as bristles, so that in the longitudinal direction a bristle is followed by a finger.

A particular relationship is maintained between the radial spans, namely ra2>ra1>ra3. Ideally at the same time, ra3>ra3*.

This arrangement of bristles has a functional purpose. The applicator and the associated wiper are specifically matched to each other so that the wiper partially wipes the one or more second rows of bristles 6*c*, preferably specifically in a region that corresponds to at least the radially outermost fifth of the bristle 6*c* and at most the radially outermost half of the bristle 6*c*. This means that the radial span ra2 of these bristles 6*c* is correspondingly greater than the wiper inner diameter AD, also see FIG. 6, which clearly shows that the radially outermost quarter of the bristle 6*c* has a radius that is greater than the corresponding wiper inner radius AD/2 so that the outermost quarter of the bristle 6*c* is folded down and wiped.

The first and third rows of fingers, which are embodied here as plates 6*b* and are situated on both sides next to the second row of fingers, perform a so-called bolstering function. Due to their embodiment in the form of plates 6*b*, these fingers are quite rigid; they therefore prevent the wiper from excessively folding over the second row of fingers, which are embodied here as relatively flexible bristles, when the applicator is pulled through the wiper.

For this purpose, the fingers of the first and second rows, with regard to their maximum radial span, are preferably embodied so that the wiper does not wipe—or preferably, essentially does not wipe—the first and third row of fingers. The expression "to be essentially not wiped" is in any case used when at most, the radially outermost sixth—and better still, at most the radially outer eighth—of these fingers is wiped. This means that the radial span ra2 of these bristles 6*c* is correspondingly greater than the wiper inner diameter AD, also see FIG. 6.

Another optional embodiment possesses a wiper wiping more intensely without imparting the bolstering function. The expression "to be essentially not wiped" means, in this case, that at most the radially outermost third and preferably at most the radially outermost fourth of the fingers of the first and the third row is wiped.

Ideally, the pattern repeats several times in the circumference direction along the core 2 of the applicator so that the applicator is kept in a central position as it passes through the wiper because the arrangement of the set of fingers is correspondingly symmetrical. It is particularly advantageous if the pattern repeats three times.

Depending on the cosmetic applicator that is claimed by the asserted claims, protection is also claimed for a cosmetic applicator that has the following additional features:

The core of the applicator has a core diameter that changes and for example becomes smaller in the direction of the longitudinal axis so that the applicator tapers in the middle, preferably in approximately the same way as a peanut. Such an applicator is then distinguished by the fact that its core diameter is greater at the tip than in the middle.

The invention claimed is:

1. A cosmetic applicator, comprising:

a rod-shaped core and a plurality of injection-molded fingers; wherein the core has a circumference surface and a non-round cross-section; the circumference surface is composed of large and small side surfaces arranged in alternating fashion; all of the large side surfaces are the same size as one another and all of the small side surfaces are the same size as one another;

wherein a set of fingers on the small side surfaces comprises plates and a set of fingers on the large side surfaces is composed exclusively of bristles; and wherein the set of fingers on the small side surfaces is composed of at least three rows of fingers situated one after another in a line extending in a direction of a longitudinal axis of the applicator; a middle row of these fingers is composed exclusively of bristles and two outer rows are rows in which bristles and plates alternate in the direction extending along the longitudinal axis of the applicator, so that a bristle is always followed by a plate and vice versa, continuing in the direction of the longitudinal axis.

2. The cosmetic applicator according to claim 1, wherein the small side surfaces are curved convexly outward.

3. The cosmetic applicator according to claim 1, wherein the circumference surface of the core is composed of at least three large and three small side surfaces arranged one after another in alternating fashion in a circumferential direction.

4. The cosmetic applicator according to claim 1, wherein the plates each have two main surfaces, two side surfaces, and one radially outer end surface; the two main surfaces extend completely or at least essentially completely perpendicular to a longitudinal axis of the applicator and the two side surfaces diverge from each other in a V shape in a radial direction.

5. The cosmetic applicator according to claim 4, wherein the radially outer end surface is oriented diagonally so that each plate has one side surface that is longer in the radial direction and one side surface that is shorter in the radial direction.

6. The cosmetic applicator according to claim 1, wherein the plates form a chisel edge at their radially outer end surfaces.

7. The cosmetic applicator according to claim 1, wherein the middle row of fingers that make up the set of fingers on the small side surfaces has a smaller total number of fingers than the two outer rows, in that only one finger belonging to the middle row is provided at a location even with that of every second finger of the two outer rows, counting in the direction of the longitudinal axis of the applicator.

8. The cosmetic applicator according to claim 1, wherein three rows of fingers, which respectively constitute the set of fingers of one of the large side surfaces, successively form the following pattern in a direction of a longitudinal axis of the applicator: one finger in each of two outer rows of fingers is arranged in a line along a shared circumference line, one plate in each of the two outer rows of bristles and one finger in a middle row of bristles are arranged in a line along a shared circumference line, one finger in each of the two outer rows of fingers is arranged in a line along a shared circumference line, one plate in each of the two outer rows of bristles and one finger in the middle row of bristles are arranged in a line along the entire subsequent circumference line.

9. The cosmetic applicator according to claim 1, wherein the fingers of the middle row are the fingers that respectively constitute the set of fingers of a small side surface and are at least ¼ longer than the fingers of the respective laterally adjacent rows belonging to the set of fingers of the same small end surface of the cosmetic applicator.

10. The cosmetic applicator according to claim 1, wherein the set of fingers of the large side surfaces is composed of only three rows of fingers respectively situated one behind another in a line extending in a direction of a longitudinal axis of the applicator, which fingers are all bristles.

11. The cosmetic applicator according to claim 1, wherein a middle row of fingers that make up the set of fingers on the large side surfaces has a smaller total number of fingers than two outer rows, in that only one finger belonging to the middle row is provided at a location even with that of every second finger of the two outer rows, counting in a direction of a longitudinal axis of the applicator.

12. The cosmetic applicator according to claim 1, wherein three rows of fingers, which respectively constitute the set of fingers of one of the large side surfaces, successively form the following pattern in a direction of a longitudinal axis of the applicator: one finger in each of two outer rows of fingers is arranged in a line along a shared circumference line, followed by a single finger in a middle row of bristles, followed by one finger in each of the two outer rows of fingers, which fingers are arranged in a line extending along a shared circumference line, followed by a single finger in the middle row of bristles.

13. The cosmetic applicator according to claim 1, wherein the fingers, in the form of bristles that form the set of fingers of the large side surfaces, are each at least ¼ shorter than an overwhelming majority of the fingers that respectively form the set of fingers of a small side surface.

14. The cosmetic applicator according to claim 1, wherein the core of the cosmetic applicator is curved in a sickle shape in one plane.

15. The cosmetic applicator according to claim 14, wherein a small side surface of the core constitutes an outside of the sickle.

16. The cosmetic applicator according to claim 14, wherein a large side surface of the core constitutes an inside of the sickle.

17. A cosmetic applicator comprising:

a rod-shaped core and plurality of fingers that are integrally connected to a circumferential surface of the core, which fingers are arranged in rows extending in a direction parallel to a longitudinal axis of the applicator, wherein in the circumferential direction, the following finger set pattern repeats a plurality of times in succession:

a first row of fingers, which is composed of plates that have a maximum span (ra1) in a radial direction, immediately adjacent to this, at least one second row of fingers, which is composed of bristles that have a maximum span (ra2) in the radial direction, immediately adjacent to the one or more second rows, a third row of fingers, which is composed of plates that have a maximum span (ra1) in the radial direction, immediately adjacent to this, a fourth row of fingers that have a maximum span (ra3) in the radial direction;

immediately adjacent to this, a fifth row of fingers is provided that have a maximum span (ra3*) in the radial direction;

and, immediately adjacent to this, a sixth row of fingers is provided that have a maximum span (ra3) in the radial direction and where: ra2 >ra1>ra3, and at the same time, ra3 >ra3*.

18. The cosmetic applicator according to claim 17, wherein the first row of fingers, the one or more second rows of fingers, and the third row are situated on a small side surface of the core.

19. The cosmetic applicator according to claim 17, wherein the fourth and the fifth row of fingers as well as the sixth row of fingers are situated on a large side surface of the core.

20. The cosmetic applicator according to claim 17, wherein the fourth and the fifth row of fingers as well as the sixth row of fingers are situated on a side surface of the core that is curved concavely inward toward the longitudinal axis of the applicator.

21. A cosmetic applicator system having a cosmetic applicator according to claim 17 and having a wiper, wherein the wiper and a span of the fingers in the radial direction are matched to each other so that the wiper essentially does not wipe the first row and third row of fingers and the wiper wipes the one or more second rows in a region that corresponds to at least the radially outermost ⅕ of the finger and at most to the radially outermost ½ of the finger and the wiper does not wipe the fourth and fifth and sixth row of fingers.

22. The cosmetic applicator system according to claim 21, wherein the cosmetic applicator is secured to a wand and a diameter of the wand is greater than an imaginary circle drawn around the longitudinal axis of the applicator, whose radius is determined by a maximum radial span (ra3) of the fourth row of fingers or by a maximum radial span of the fingers of the fourth or fifth or sixth row of fingers that protrude the farthest in the radial direction.

* * * * *